US008066538B1

(12) United States Patent
Kostrzewski

(10) Patent No.: US 8,066,538 B1
(45) Date of Patent: Nov. 29, 2011

(54) JET BOAT WITH ENGINE-BALANCE SYSTEM

(76) Inventor: Krzysztof A. Kostrzewski, Sylvania, OH (US)

( * ) Notice: Subject to any disclaimer, the term of this patent is extended or adjusted under 35 U.S.C. 154(b) by 258 days.

(21) Appl. No.: 12/617,612

(22) Filed: Nov. 12, 2009

(51) Int. Cl.
*B63H 11/107* (2006.01)

(52) U.S. Cl. ..... 440/40; 114/151

(58) Field of Classification Search ..... 440/38, 440/40, 43, 46; 114/151
See application file for complete search history.

(56) References Cited

U.S. PATENT DOCUMENTS

| | | | | |
|---|---|---|---|---|
| 3,137,266 | A * | 6/1964 | Perrier et al. | 440/43 |
| 3,447,554 | A * | 6/1969 | Josephson | 441/21 |
| 3,492,965 | A * | 2/1970 | Wayfield | 440/40 |
| 3,797,447 | A * | 3/1974 | Stubblefield | 440/1 |
| 5,090,929 | A * | 2/1992 | Rieben | 440/40 |
| 5,404,830 | A | 4/1995 | Ligozio | |
| 5,655,473 | A | 8/1997 | Arvilla | |
| D397,988 | S | 9/1998 | Brooks et al. | |
| 6,024,038 | A * | 2/2000 | Kiliz et al. | 114/151 |
| 6,164,230 | A * | 12/2000 | Beauchamp | 114/151 |
| 6,325,683 | B1 * | 12/2001 | Yocom | 440/6 |
| 6,544,081 | B1 | 4/2003 | Paulo | |
| 6,883,450 | B2 | 4/2005 | Kingsbury | |
| 7,188,575 | B2 | 3/2007 | Baker | |
| 2003/0145776 | A1 | 8/2003 | Burg | |

* cited by examiner

*Primary Examiner* — Stephen Avila

(57) ABSTRACT

A jet boat comprising an engine-balance system, the engine-balance system comprising a first impeller and a second impeller, wherein water can be driven out of the first impeller for forward motion and water can be selectively driven out of the second impeller, regulated by a balance detecting device, wherein water from the second impeller can provide balance to the jet boat.

5 Claims, 9 Drawing Sheets

JET BOAT WITH ENGINE-BALANCE SYSTEM

FIELD OF THE INVENTION

The present invention is directed to jet boat, more particularly to a jet boat having two impellers for providing both forward motion and balance.

BACKGROUND OF THE INVENTION

A jet boat is a boat propelled by a jet of water ejected from the back of the craft. Unlike a powerboat or motorboat that uses a propeller in the water below or behind the boat, a jet boat draws the water from under the boat into a water jet inside the boat where it passes through as series of impellers and stators (also known as stages), which increase the velocity of the water flow. The water jet delivers a high pressure push and expels the water (jet stream) through a nozzle at the rear of the jet boat either above or below the waterline, which pushes the boat forward. Steering is accomplished by moving this nozzle to either side, or less commonly, by small gates on either side that direct the jet stream. For reverse motion, a water jet will continue to pump normally, but a deflector is lowered into the jet stream leaving the nozzle. This deflector redirects thrust forces forward to provide reverse motion.

The present invention features an engine-balance system for a jet boat. The engine-balance system comprises a first impeller for providing forward motion and a second impeller for providing balance to the jet boat.

Without wishing to limit the present invention to any theory or mechanism, it is believed that the boat of the present invention provides controlled operation for minimal resistance, a smooth car-like ride, and comfort for the occupants. The jet boat of the present invention may also provide comfort for the occupants by protecting them from hot or cold temperatures as well as splashing water while riding.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 1:
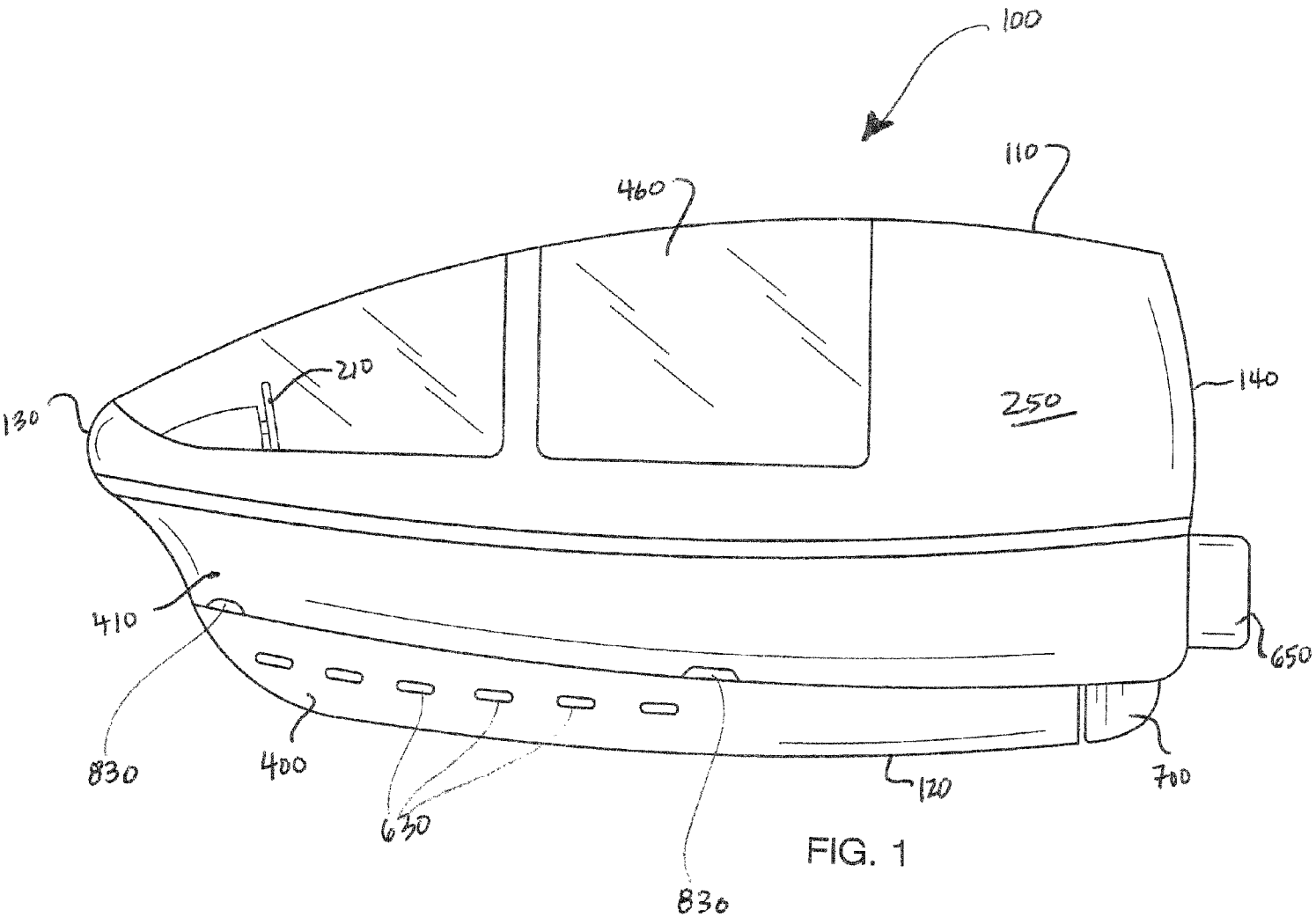
FIG. 1 is a side view of the jet boat of the present invention as viewed from the left side.
Figure 2:
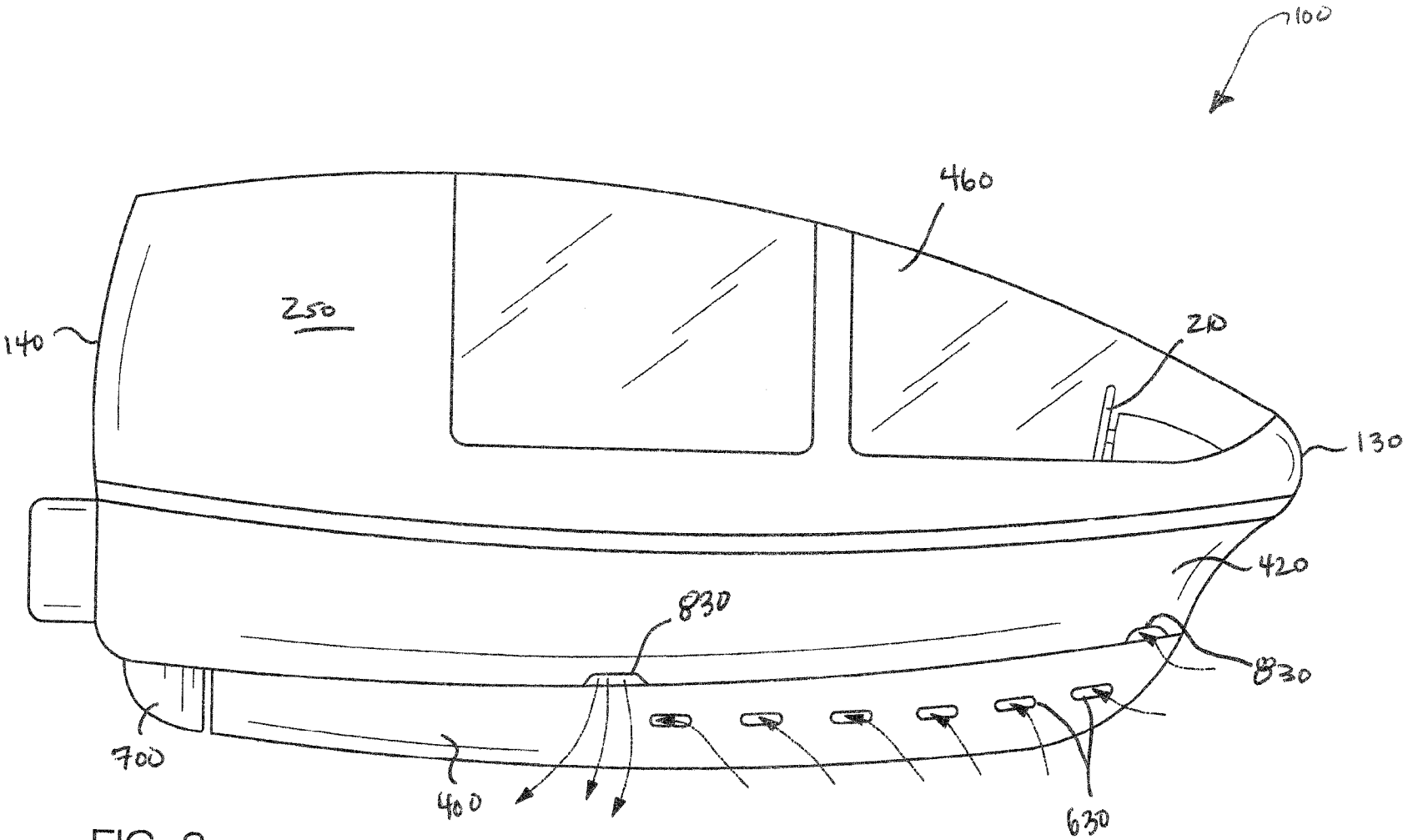
FIG. 2 is a side view of the jet boat of the present invention as viewed from the right side.
Figure 3:
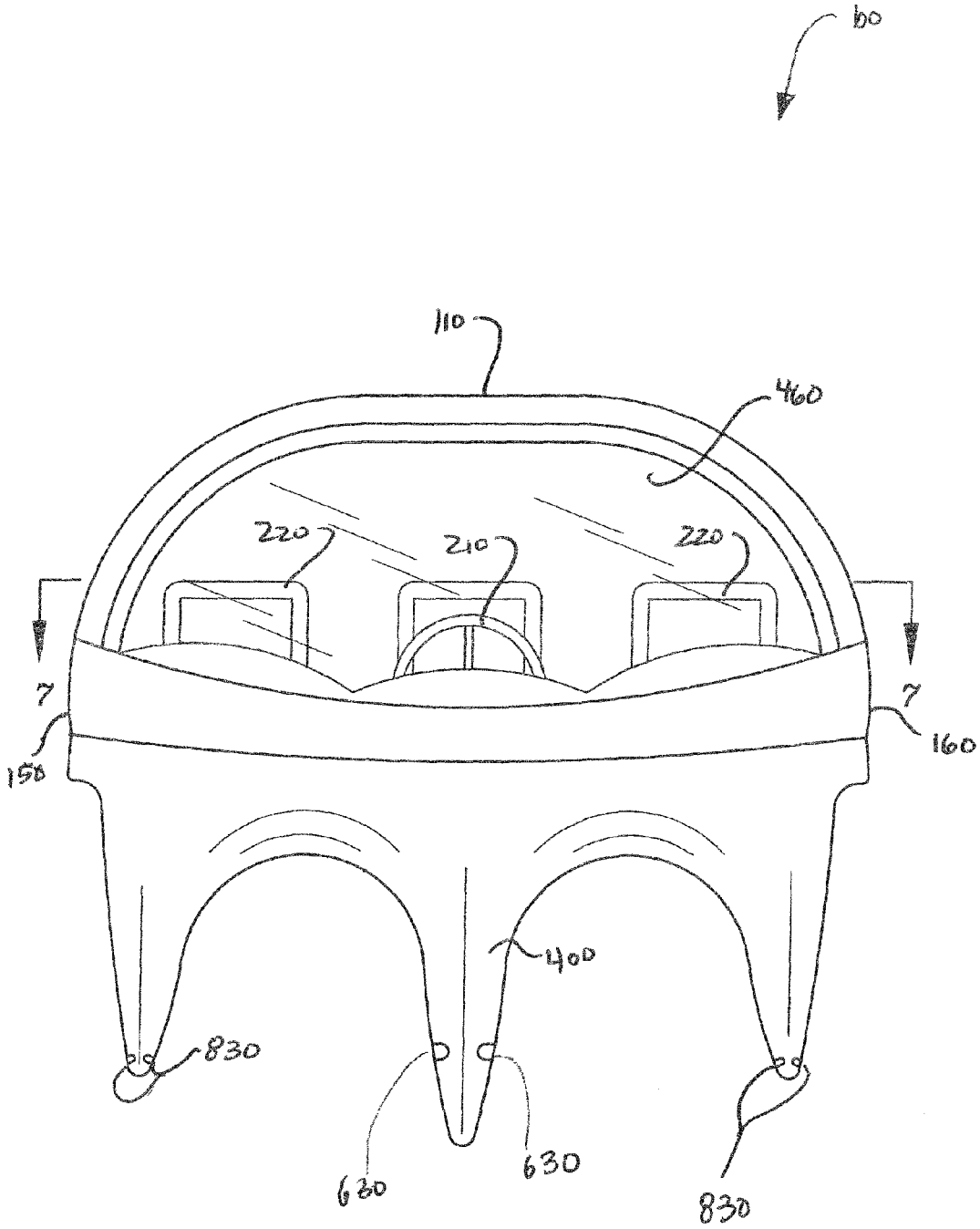
FIG. 3 is a front view of the jet boat of the present invention.
Figure 4:
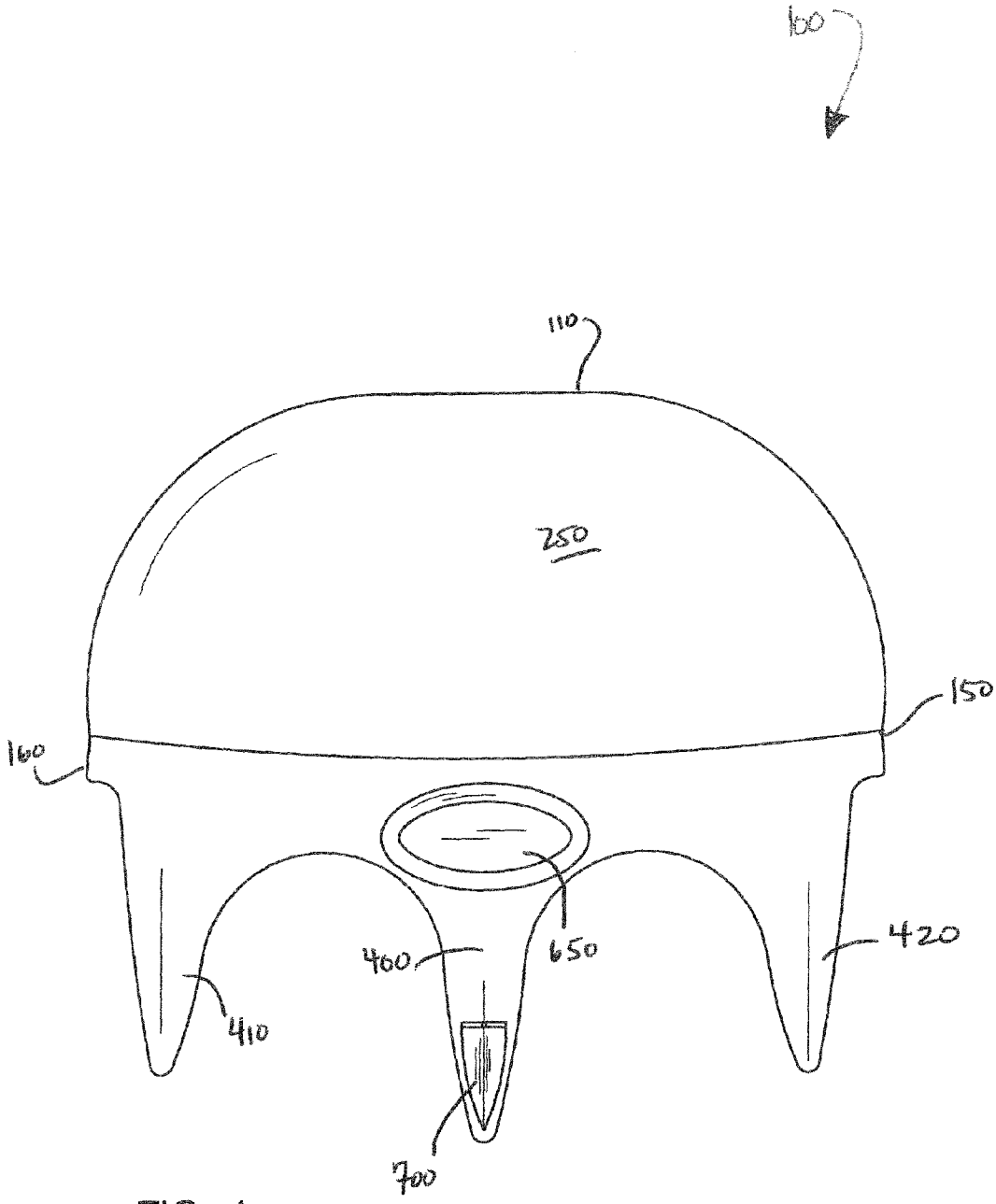
FIG. 4 is a rear view of the jet boat of the present invention.
Figure 5:
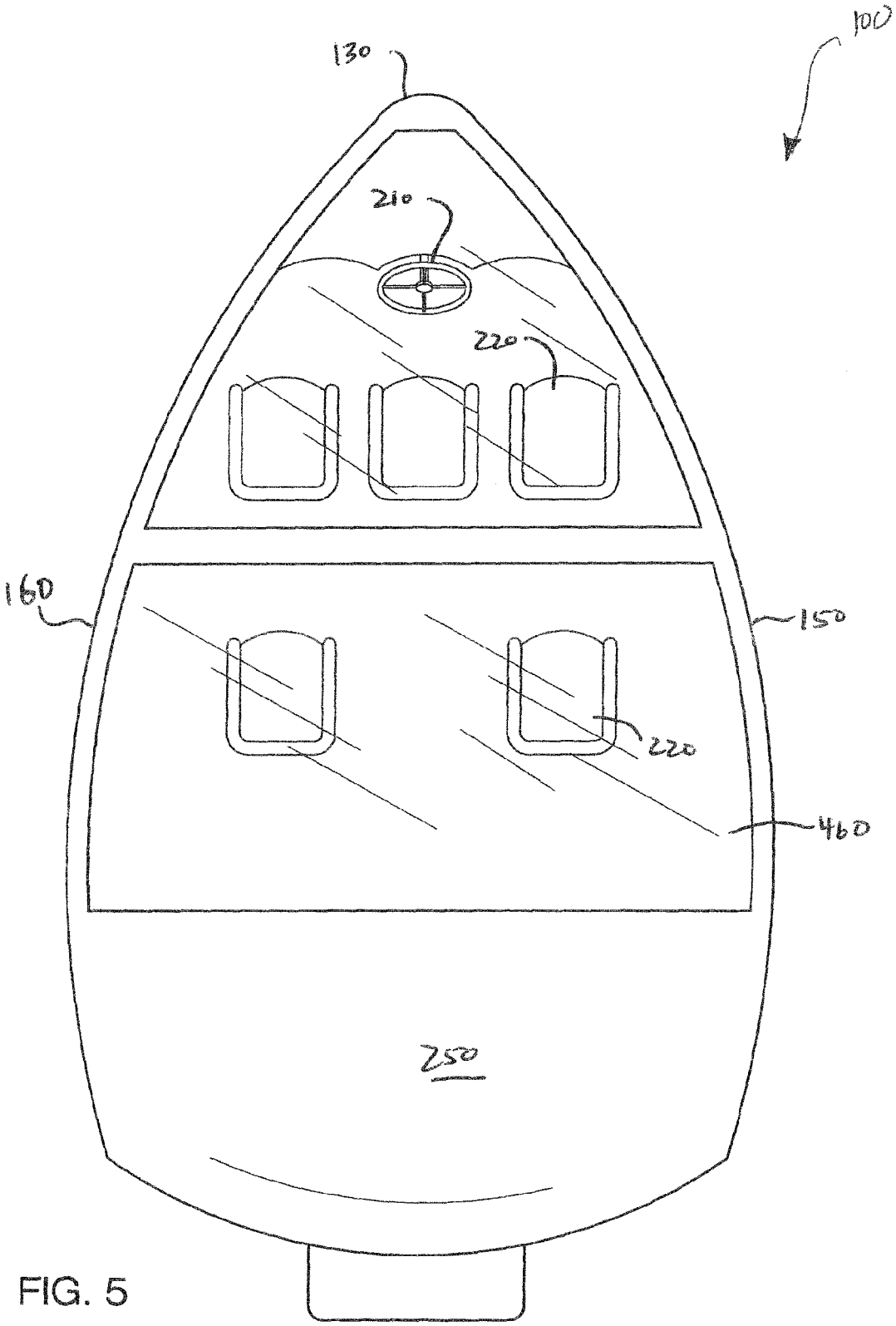
FIG. 5 is a top view of the jet boat of the present invention.
Figure 6:
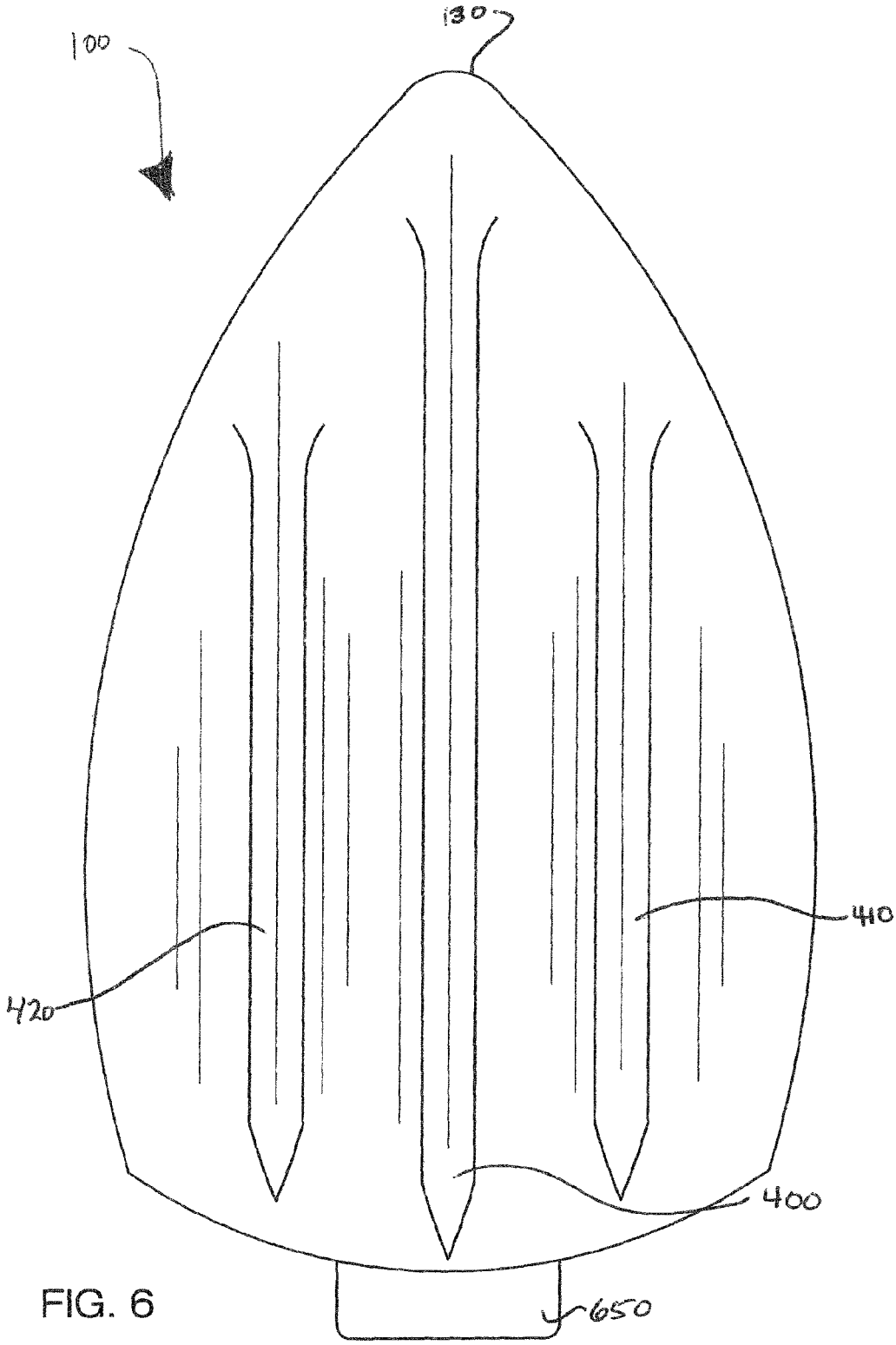
FIG. 6 is a bottom view of the jet boat of the present invention.
Figure 7:
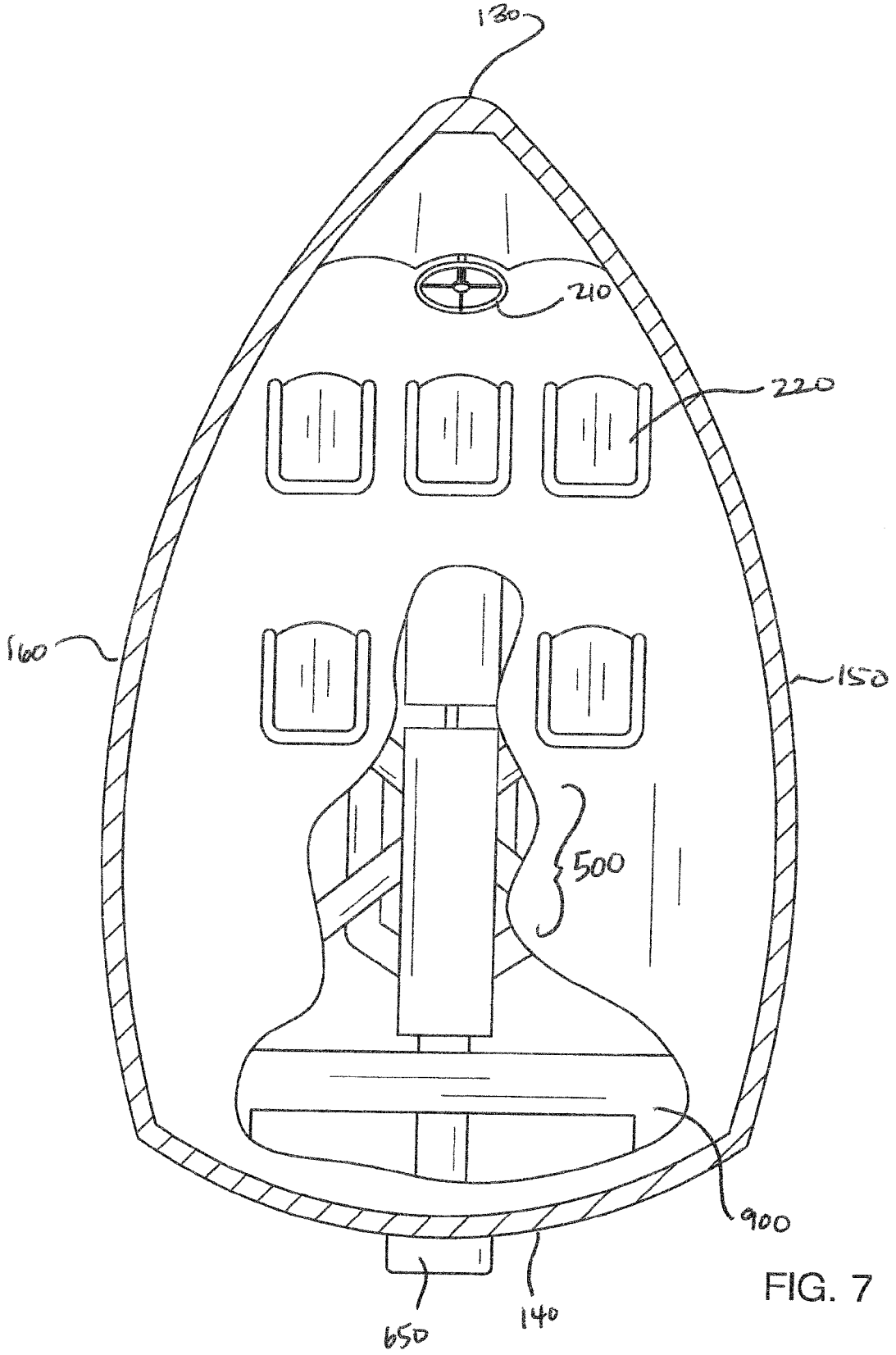
FIG. 7 is a top view of the jet boat of the present invention also showing the engine, shaft, and fuel tank inside of the boat underneath the floor.
Figure 8:
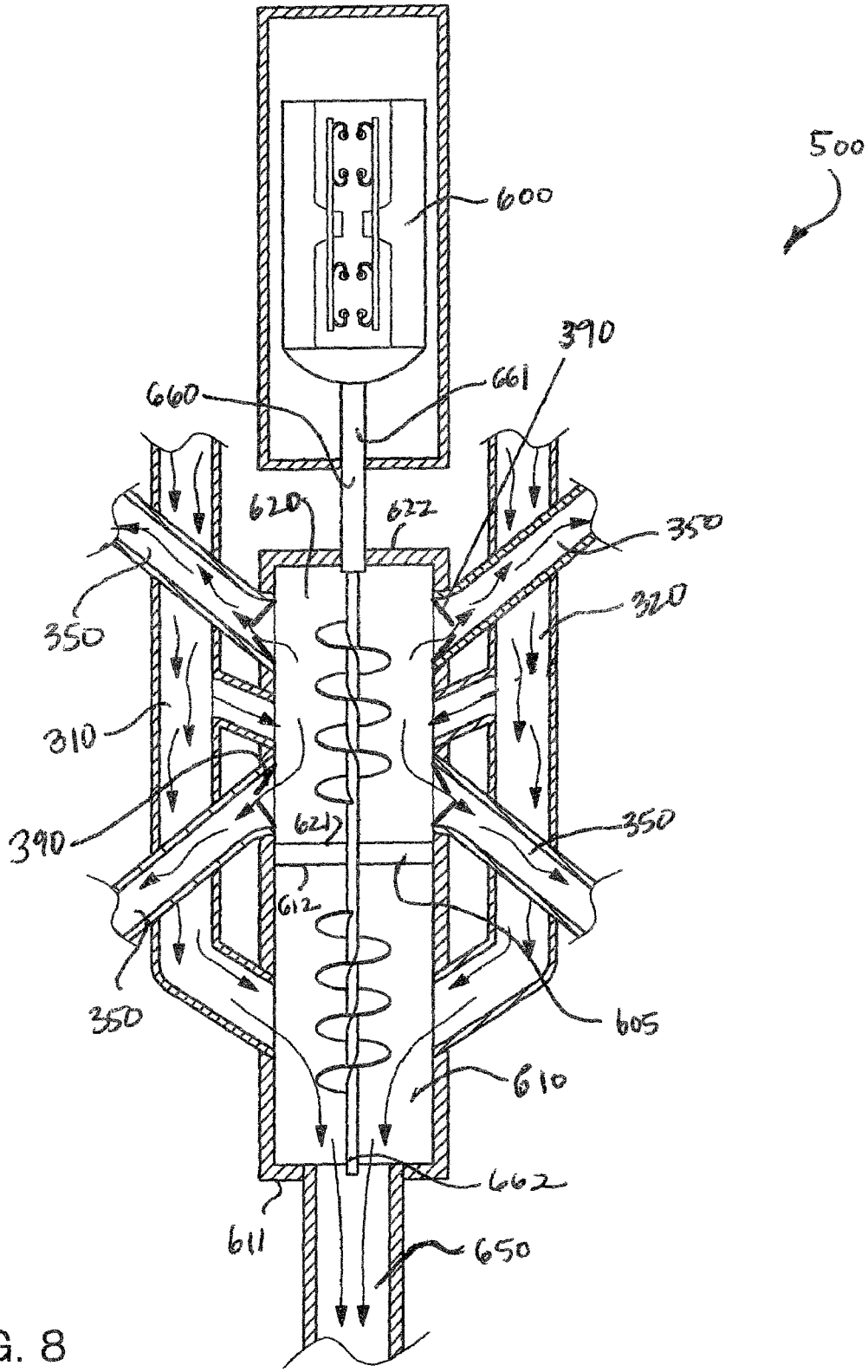
FIG. 8 is a cross sectional view of the engine-balance system of the present invention.
Figure 9:
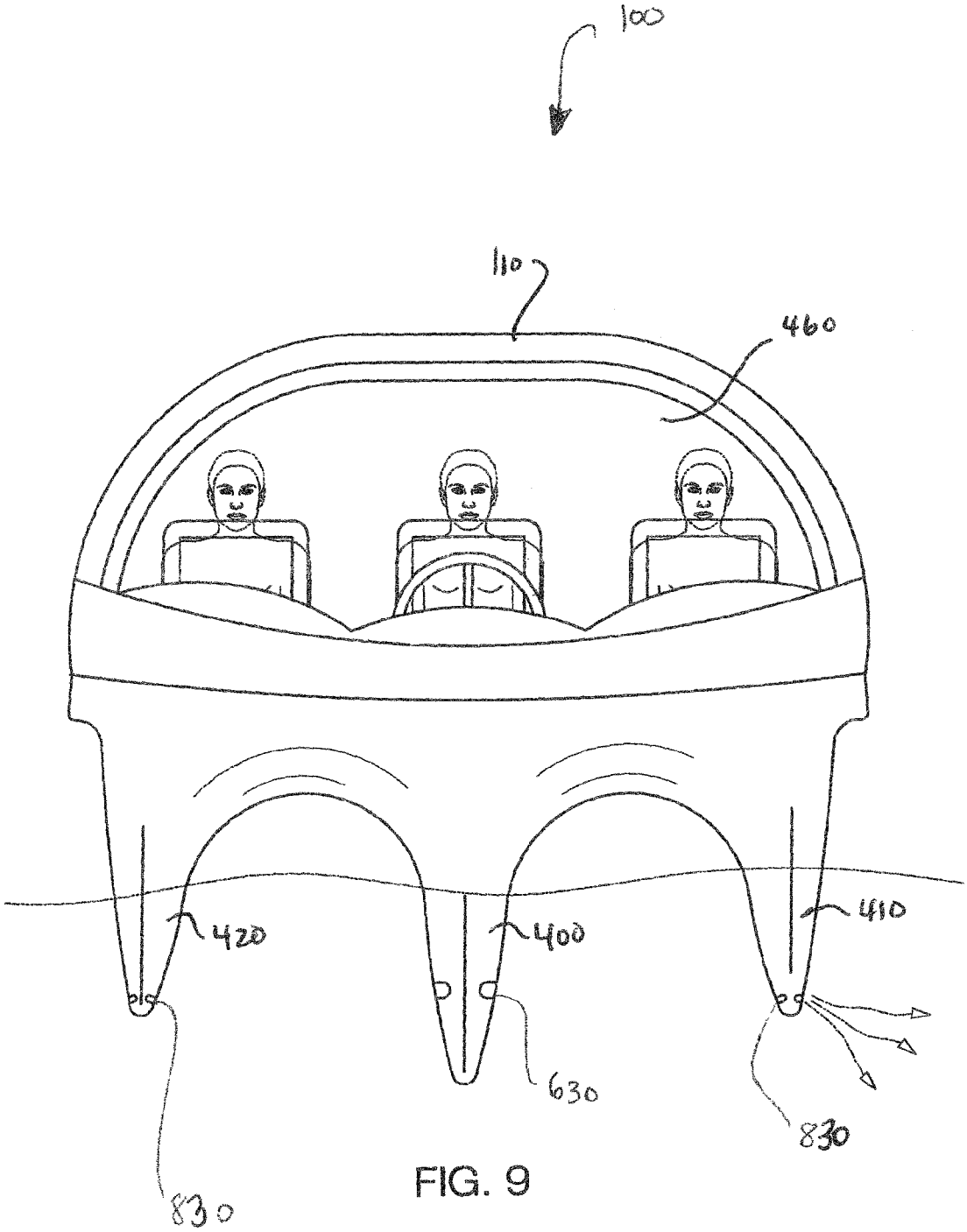
FIG. 9 is a front view of the jet boat of the present invention.

The following is a listing of numbers corresponding to a particular element refer to herein:

100 jet boat
110 top of boat
120 bottom of boat
130 front of boat
140 back of boat
150 first side of boat
160 second side of boat
210 steering wheel
220 seat
250 enclosure
310 first intake pipe
320 second intake pipe
350 exit pipe
390 semi-valve
400 center hull
410 first side hull
420 second side hull
460 window
500 engine-balance system
600 engine
605 seal
610 first impeller
611 first end of first impeller
612 second end of first impeller
620 second impeller
621 first end of first impeller
622 second end of first impeller
630 water intake pump
650 jet pump nozzle
660 engine shaft
661 first end of engine shaft
662 second end of engine shaft
700 steering device
830 exit pipe aperture
900 fuel tank Referring now to FIGS. 1-9, the present invention features an engine-balance system 500 for a jet boat 100. The jet boat 100 may be similar in size and/or shape as compared to a standard jet boat well known to one of ordinary skill in the art. For example, the jet boat 100 has a top 110, a bottom 120, a front 130, a back 140, a first side 150, and a second side 160. In some embodiments, the jet boat 100 comprises an enclosure 250 that houses a floor, one or more seats 220, one or more windows 460, a fuel tank 900, and a steering wheel 210. In some embodiments, a first side hull 410, a center hull 400, and a second side hull 420 are disposed on the bottom 120 of the jet boat 100.

The engine-balance system 500 of the present invention comprises a first impeller 610 having a first end 611, a second end 612, a first side, and a second side. Connected to the second end 612 of the first impeller 610 is a second impeller 620 having a first end 621, a second end 622, a first side, and a second side. A seal 605 separates the second end 612 of the first impeller 610 and the first end 621 of the second impeller 620.

The engine-balance system 500 of the jet boat 100 further comprises an engine 600. In some embodiments, an engine shaft 660 having a first end 661 and a second end 662 extends from the engine 600 through the second impeller 620, through the seal 605, and through the first impeller 610. For example, the first end 661 of the engine shaft 660 is driven through the second impeller 620 to the first impeller 610 and the second end 662 of the engine shaft 660 is operatively connected to the engine 600. When the engine 600 is activated, the engine 600 rotates the engine shaft 660.

The engine-balance system 500 further comprises a first water intake pipe 310 having a first end and a second end and a second water intake pipe 320 having a first end and a second end. The first water intake pipe 310 and second water intake pipe 320 are both fluidly connected to the first impeller 610 and second impeller 620. Water is taken in from outside the jet boat 100 via one or more intake pumps 630 and is then transported through the first water intake pipe 310 and the second water intake pipe 230. From the first intake pipe 310 and second intake pipe 320, water travels to the first impeller 610. A portion of the water from the intake pipes can travel into the second impeller 620.

In some embodiments, the first impeller 610 increases the velocity of the water. In some embodiments, the water inside the first impeller 610 is forced (e.g., via the engine 600 and engine shaft 660) through the first end 611 of the first impeller 610 and through the fluidly connected jet pump nozzle 650 disposed at the back 140 of the jet boat 100 (see FIG. 1). This forced water provides forward motion for the jet boat 100.

Water from inside the second impeller 620 can, in a regulated manner, be forced out of the second impeller 620 via one or more exit pipes 650. For example, in some embodiments, an exit pipe 650 (e.g., a first exit pipe) can extend from the second impeller 620 to a portion of the first side hull 410 near the back 140 of the jet boat 100. In some embodiments, an exit pipe 650 (e.g., a second exit pipe) can extend from the second impeller 620 to a portion of the first side hull 410 near the front 130 of the jet boat 100. In some embodiments, an exit pipe 650 (e.g., a third exit pipe) can extend from the second impeller 620 to a portion of the second side hull 420 near the back 140 of the jet boat 100. In some embodiments, an exit pipe 650 (e.g., a fourth exit pipe) can extend from the second impeller 620 to a portion of the second side hull 420 near the front 130 of the jet boat 100.

From the exit pipes 650, water can exit the jet boat 100 via an exit pipe aperture 830. The second impeller 620 and the exit pipes 650 are fluidly connected. In some embodiments, a semi-valve 390 separating the second impeller 620 the exit pipe 650. The semi-valve 390 allows for controlled release of water from the second impeller 620 through the exit pipe 650. The semi-valves 390 can move between an open position and a closed position. In some embodiments, the semi-valves 390 are biased in the closed position. The water forced out of the second impeller 620 may be used to control the balance of the jet boat 100. For example, in some embodiments, the semi-valves 390 are operatively connected and regulated by a balance detecting device (e.g., a gyroscope). When the balance detecting device detects an imbalance in the boat, the device can selectively move one or more of the semi-valves 390 to the open position so as to offset the imbalance.

In some embodiments, the first impeller 610 is for providing forward motion. In some embodiments, the second impeller 620 is for providing balance. Without wishing to limit the present invention to any theory or mechanism, it is believed that the engine-balance system 500 of the present invention provides excellent balance capabilities for balance on waves and would provide a smooth and stable ride. In some embodiments, the first impeller 610 has a reversed pitch as compared to the second impeller 620.

In some embodiments, steering of the jet boat 100 is accomplished via a steering system 700 disposed on the center hull 400 at the back 140 of the jet boat 100. The steering system 700 may be controlled with a steering wheel located inside the jet boat 100.

In some embodiments, the engine 600 is a standard four-stroke engine. In some embodiments, the engine 600 has a turbocharger.

In some embodiments, the jet boat 100 comprises one or more skylights. In some embodiments, the enclosure 250, windows 460, and/or skylights completely enclose the jet boat 100. In some embodiments, enclosing the jet boat 100 may help protect the occupants from hot or cold temperatures and/or splashing water. In some embodiments, the enclosure 250 comprises a retractable roof. In some embodiments, the windows 460 and/or skylights are retractable. In some embodiments, the windows 460 and/or skylights are large and curved for optimum visibility. In some embodiments, the jet boat 100 comprises a plurality of seats 220. For example, three seats 220 may be disposed near the front 130 of the jet boat 100 and two seats 220 may be disposed in the center of the jet boat 100.

In some embodiments, the jet boat 100 of the present invention may be used for recreational purposes, commercial purposes, and/or military purposes. The jet boat 100 of the present invention may operate on various different bodies of water such as rivers, lakes, bays, and oceans.

The jet boat 100 of the present invention may be constructed in a variety of sizes. As used herein, the term "about" refers to plus or minus 10% of the referenced number. For example, an embodiment wherein the jet boat 100 is about 20 feet long includes a jet boat that is between 18 feet and 22 feet long.

In some embodiments, the jet boat 100 is about 6 feet tall as measured from the bottom 120 of the jet boat 100 to the top 110 of the jet boat 100. In some embodiments, the jet boat 100 is between about 5 feet and 8 feet tall as measured from the bottom 120 to the top 110. In some embodiments, the jet boat 100 is between about 8 feet and 12 feet tall as measured from the bottom 120 to the top 110. In some embodiments, the jet boat 100 is between about 12 feet and 20 feet tall as measured from the bottom 120 to the top 110.

In some embodiments, the jet boat 100 is about 20 feet long as measured from the front of the jet boat 100 to the back of the jet boat 100. In some embodiments, the jet boat 100 is between about 10 feet and 15 feet long as measured from the front 130 to the back 140. In some embodiments, the jet boat 100 is between about 15 feet and 20 feet long as measured from the front 130 to the back 140. In some embodiments, the jet boat 100 is between about 20 feet and 25 feet long as measured from the front 130 to the back 140. In some embodiments, the jet boat 100 is between about 25 feet and 30 feet long. In some embodiments, the jet boat 100 is between about 30 feet and 35 feet long.

In some embodiments, the jet boat 100 is about 5 feet wide as measured from the first side 150 to the second side 160. In some embodiments, the jet boat 100 is between about 5 feet and 10 feet wide as measured from the first side 150 to the second side 160. In some embodiments, the jet boat 100 is between about 10 feet and 15 feet wide as measured from the first side 150 to the second side 160. In some embodiments, the jet boat 100 is between about 15 feet and 20 feet wide as measured from the first side 150 to the second side 160.

The jet boat 100 may be constructed from a variety of materials. For example, in some embodiments, the first side hull 610, the central hull 400, and/or the second side hull 420 are constructed from a material comprising fiberglass. In some embodiments, the hulls are constructed with a gel-coat finish.

The following the disclosures of the following U.S. patents are incorporated in their entirety by reference herein: U.S. Pat. No. 5,655,473; U.S. Pat. Application No. 2003/0145776; U.S. Pat. No. 7,188,575; U.S. Pat. No. 6,883,450: U.S. Pat. No. 5,404,830; U.S. Pat. No. 6,544,081.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. An engine-balance system for a jet boat having a first side hull, a second side hull, and a central hull, the engine-balance system comprising:

(a) a first impeller having a first end and a second end and a second impeller having a first end and a second end; wherein the first end of the second impeller is connected to the second end of the first impeller;

(b) an engine;

(c) an engine shaft having a first end and a second end extending from the engine through both the first impeller and the second impeller; wherein the engine is for driving the engine shaft;

(d) a first water intake pipe fluidly connected to both the first impeller and to the second impeller;

(e) a second water intake pipe fluidly connected to both the first impeller and to the second impeller; wherein water from outside the jet boat is driven through both the first water intake pipe and the second water intake pipe via one or more water intake pumps disposed in the central hull; wherein water from both the first intake pipe and second intake pipe is further driven to the first impeller and to the second impeller;

(f) a jet pump nozzle fluidly connected to the first end of the first impeller; wherein water from the first impeller is forced through the jet pump nozzle and outside of the jet boat via the engine and engine shaft;

(g) a first exit pipe fluidly connecting the second impeller to a first exit pipe aperture disposed on the first side hull; a second exit pipe fluidly connecting the second impeller to a second exit pipe aperture disposed on the first side hull; a third exit pipe fluidly connecting the second impeller to a third exit pipe aperture disposed on the second side hull; a fourth exit pipe fluidly connecting the second impeller to a fourth exit pipe aperture disposed on the second side hull; wherein water from the second impeller can be driven outside of the jet boat via at least one of the exit pipes;

(h) a balance detecting device for detecting an imbalance of the jet boat; and (i) a semi-valve separating each of the exit pipes from the second impeller; each semi-valve being movable between an open position and a closed position and biased in the closed position; wherein each semi-valve is operatively connected to the balance detecting device; wherein when the balance detecting device detects an imbalance, the balance detecting device can selectively move one or more of the semi-valves to the open position for allowing water to exit the second impeller so as to offset the imbalance;

wherein the first impeller is for providing forward motion to the jet boat; wherein the second impeller is for providing balance to the jet boat.

2. The engine-balance system of claim 1, wherein a seal separates the second end of the first impeller and the first end of the second impeller.

3. The engine-balance system of claim 1, wherein the engine is a four stroke engine.

4. The engine-balance system of claim 1, wherein the engine comprises a turbocharger.

5. The engine-balance system of claim 1, wherein the jet boat comprises an enclosure having a retractable roof.

* * * * *